United States Patent [19]

Winthrop

[11] Patent Number: 4,627,758

[45] Date of Patent: Dec. 9, 1986

[54] NAIL POLISH REMOVING APPARATUS

[76] Inventor: Marilyn P. Winthrop, 54 Magnolia Hill Rd., West Hartford, Conn. 06117

[21] Appl. No.: 728,688

[22] Filed: Apr. 29, 1985

[51] Int. Cl.[4] ..... A45D 34/00; A45D 34/04; B05C 17/02

[52] U.S. Cl. ..... 401/208; 401/218; 401/220; 132/74.5

[58] Field of Search ..... 401/208, 17, 218, 220; 132/74.5

[56] References Cited

U.S. PATENT DOCUMENTS 154,195 8/1974 Smith ..... 401/208
2,057,085 10/1936 Danco ..... 401/208
3,341,884 9/1967 Pryor ..... 401/17
4,112,536 9/1978 Carson, Jr. et al. ..... 401/208 X

FOREIGN PATENT DOCUMENTS 676595 7/1952 United Kingdom ..... 401/218

*Primary Examiner*—Steven A. Bratlie
*Attorney, Agent, or Firm*—Robert S. Smith

[57] ABSTRACT

A nail polish removing apparatus which includes an elongated hollow housing having a first opening at a first end thereof, a reservoir for nail polish removing fluid disposed in the housing, and an absorbent material extending from the reservoir to the opening. In one form of the invention the absorbent material is in the form of a continuous belt. Axial sections of the belt are movable from the opening to the reservoir.

2 Claims, 5 Drawing Figures

NAIL POLISH REMOVING APPARATUS

BACKGROUND OF THE INVENTION

The invention relates to personal care products and particularly to apparatus for removing nail polish. The customary procedure for removing nail polish has been to use a container of nail polish removing fluid with cotton balls, swabs or tissue. For the purpose of explanation cotton balls with be referred to, although other wiping materials may be used. The technique requires the user to apply the nail polish removing fluid to a cotton ball and then rub the nail on which the nail polish is disposed. This technique requires multiple cotton balls in order to complete the removal of all polish from all fingernails or toenails. Limitations of this procedure include the cumbersomeness of the procedure and the adequacy of the polish removal along the edge of the nail. In addition, there is a necessity to provide for disposal of the waste wiping material.

As to the first problem it will be understood that typically the user will be applying a removing fluid with one hand to the fingernails of the other hand. Thus, the user is obliged either to recap or close the container with the nail polish removing fluid or find a level place to put the bottle of nail polish removing fluid after first wetting the cotton ball. This procedure must be repeated with a first cotton ball and then with additional cotton balls.

The importance of providing a closed container of nail polish removing fluid and avoiding tipping of the open container are accentuated by the damage which may be done to various wooden and other surfaces by the polish removing fluid, as well as the offensive odors produced by an open container of polish removing fluid. In addition waste wiping material may also have objectionable odors. The surface on which the open container is placed is particularly vulnerable and must be flat, horizontal and stable to avoid adverse effects.

Gel products are also on the market, which are not wholly satisfactory because the container is relatively large and cumbersome. In addition, the user must twist the nail inside the container to use this method. Accordingly, the method is suitable only for finger nails.

An additional problem with the gel product relates to the ineffectiveness in removing polish along the margins of the finger or toenail. Because the skin surrounding the finger or toe nail is not flush with the nail, the crevice at the juncture of the skin and the nail is particularly difficult to reach with a cotton ball.

It is an object of the invention to provide apparatus which the user may more easily use without the complications inherent in using cotton balls or other separate wiping materials with a bottle of nail polish removing fluid or gel products, which will also require the use of cuticle edger devices for removing polish.

It is another object of the invention to provide apparatus which is self contained.

It is another object of the invention to eliminate the wiping material disposed problem.

SUMMARY OF THE INVENTION

It has now been found that these and other objects of the invention may be attained in a nail polish removing apparatus which comprises an elongated hollow housing having a first opening at a first end thereof, a reservoir for nail polish removing fluid disposed in the housing and an absorbent material extending from the reservoir to the first opening.

The absorbent material may be a continuous belt of absorbent material and the apparatus may further include means for mounting the belt to permit axial portions of the belt to move from the reservoir to the first opening in the housing. The means for mounting may comprise first and second mounting rollers disposed at axially spaced points. The means for mounting may include means extending out of the elongated hollow housing for permitting manual rotation of one of the mounting rollers to cause axial portions of the belt to move from the reservoir to the first opening. The means for permitting manual rotation may comprise a knob disposed on the outside of the housing and connected by a shaft to one of the mounting rollers. The apparatus may further include seal means extending across the housing and around the absorbent material to isolate the reservoir from the first opening in the housing. The seal means may comprise elongated openings and the elongated openings may engage discrete axial sections of the belt. The elongated openings may be bounded by at least one rotatably mounted squeezing roller. The apparatus may further include a second opening in the housing which is remotely disposed from the first opening.

BRIEF DESCRIPTION OF THE DRAWING

The invention will be better understood by reference to the accompanying drawing in which.

DESCRIPTION OF THE PREFERRED EMBODIMENT

Figure 1:
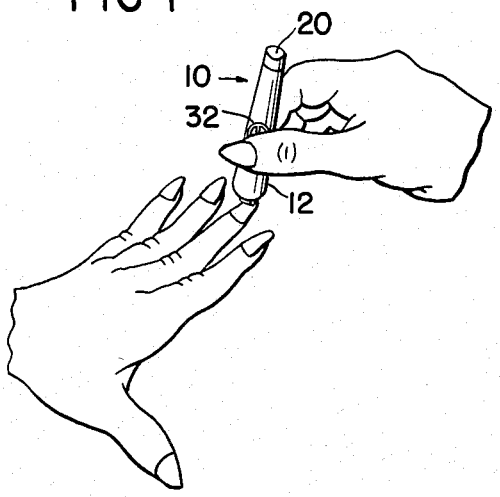
FIG. 1 is a perspective view of the apparatus in accordance with the invention being used to remove nail polish.
Figure 2:
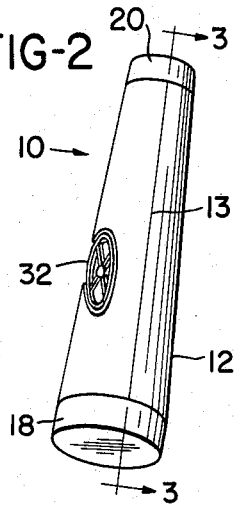
FIG. 2 is a perspective view of the apparatus in greater detail.
Figure 3:
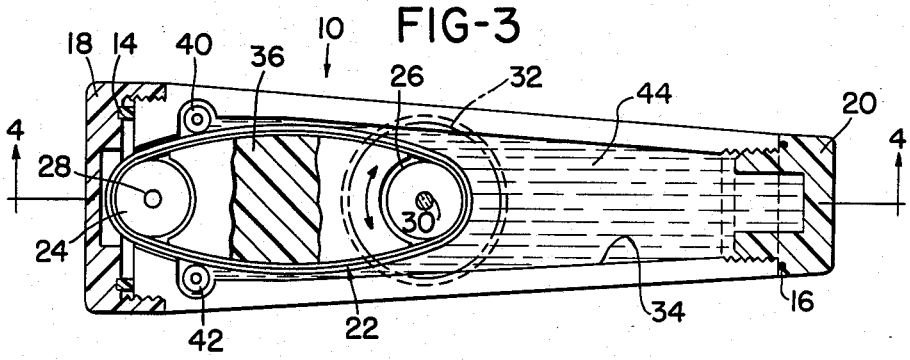
FIG. 3 is an enlarged section taken along the line 3—3 of FIG. 2.
Figure 4:
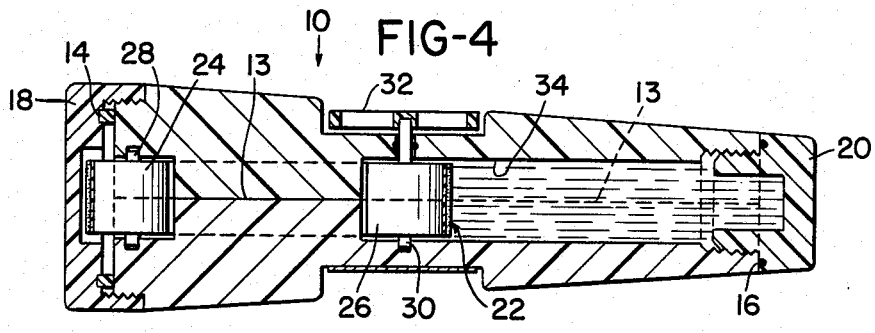
FIG. 4 is a section taken along the line 4—4 of FIG. 3.

It will be understood that the drawing shows an embodiment of the invention that has a relatively large diameter in order to more clearly show the internal mechanism. Other embodiments will be more slender.

Referring now to FIGS. 1–5, there is shown a preferred embodiment of the nail polish removing apparatus 10 in accordance with the invention. The apparatus 10 includes an elongated hollow housing 12, having a split construction divided along a parting line 13, to allow assembly of the internal components. The housing 12 has a first opening at a first end and a second opening at a second and thereof. The openings are constructed to cooperate with respective first and second caps 18, 20 which are provided with respective seals 14, 16.

The first cap 18 is removable to expose an axial portion of a continuous belt 22, which is mounted on mounting rollers 24, 26. The mounting rollers 24, 26 are disposed at axially spaced intervals within the elongated hollow housing 12. The mounting rollers 24, 26 are mounted on respective shafts 28, 30. The shaft 28 cooperates and supports the mounting roller 24, which is mounted very close to the first opening so that the continuous belt 22, which extends around the face of the mounting roller 24, thus projects out the first opening.

The first mounting roller 24 may be fixed to the shaft 28 and the shaft 28 may move with respect to the elongated hollow body or housing 12. Alternatively, the shaft 28 will be mounted for rotation with respect to the roller 24. The second mounting roller 26 is mounted on the shaft 30 to which it is fixed. That shaft 30 extends through the wall of the elongated hollow housing 12 and has an external knob 32. It will thus be seen that rotation of the external knob 32 causes the second mounting roller 26 to rotate, which causes movement of the continuous belt 22 which in turn causes the first mounting roller 24 to rotate.

Defined within the elongated hollow body 12 is a reservoir 34, which surrounds a portion of the continuous belt 22. The reservoir 34 is defined by the axial portion of the elongated hollow housing 12, which extends between the second cap 20 and a guide 36 extending across the housing 12. Preferably, the guide 36 constitutes a membrane or belt guide or wall which has two squeezing rollers 40 and 42 disposed on one side of each of two openings defined between the housing 12 and the oval belt guide 36. This structure will be somewhat similar to the rollers on a wringing apparatus such as that used on domestic washing machines manufactured in the 1940's. The squeezing rollers 40 and 42 are spaced apart and dimensioned to cooperate with the particular thickness of the absorbent belt 22 so that substantially all of a nail polish removing fluid 44 is disposed in the reservoir 34 except the nail polish removing fluid 44 which is actually absorbed by the belt 22. A quantity of the nail polish removing fluid 44 will be absorbed by the belt 22 and be moved with the belt 22 as the belt 22 is moved through the squeezing rollers 40 or 42 into the first opening.

As a moist axial section of the continuous belt 22 passes into the first opening and seal 14, that axial section is ready for removal of nail polish. The user will rub that axial section against a nail which is coated with nail polish and thus remove all the polish from a given area. Thereafter the user will turn the external knob 32, causing another axial section of the belt 22, which is also moist, to be exposed in the first opening and seal 14. The movement of successive axial sections of the continuous belt 22 so that successive axial sections thereof are exposed in the first opening and seal 14 occurs as the continuous belt 22 passes through the two squeezing rollers 40, 42. The axial sections of the continuous belt 22 which have been used to remove nail polish are returned to the reservoir 34 as fresh axial sections of the belt 22 are advanced to the first opening and seal 14. It has been established that the axial sections of the belt 22 that have been used for cleaning operations, which are thereafter returned to the reservoir 34, will thus be cleaned as they sit in the reservoir 34 section and the residue forming on these axial reservoir 34 sections will be suspended in the nail polish removing fluid 44 which is disposed in the reservoir 34.

Figure 5:
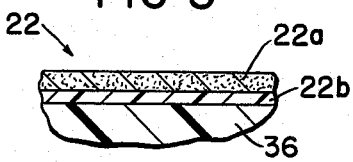
FIG. 5 is an enlarged broken away view in partial section showing the absorbent body.

As best shown in FIG. 5, the belt 22 has a first absorbent lamination 22*a* and a backing 22*b*, which provides support for the absorbent lamination 22*a*.

Although the preferred embodiment has a continuous belt 22, it will be understood that various other forms of the invention may be even more simple in construction. For example, the invention may simply be a wick extending from a reservoir 34 through the first opening and seal 14. The absorbent material or wick in its simplest form does not move.

It will thus be seen that the apparatus 10 in accordance with the invention provides a very easy to use apparatus which is very compact and easily carried and which may be easily refilled by adding the fresh nail polish removing fluid 44 to the opening surrounded by the seal 16 which is covered by the second cap 20. The fluid 44 may be entirely emptied out through that opening surrounded by the seal 16 and replaced with fresh fluid 44 at the user's convenience. The relatively small size of the roller 24, particularly in some embodiments, enables the user to easily reach the crevice defined between the nail and the skin surrounding the nail so that all of the polish may be easily removed from the nail. It will also be seen that the apparatus 10 will be very convenient to travel with said to use in a facile manner without the cumbersomeness inherent in the more conventional cotton ball and bottle of nail polish removing fluid 44 approach.

The invention has been described with reference to its illustrated preferred embodiments. Persons skilled in the art may, upon exposure to the teachings herein, conceive variations in the mechanical development of the components therein. Such variations are deemed to be encompassed by the disclosure, the invention being delimited only by the appended claims.

Having thus described my invention, I claim:

1. A nail polish removing apparatus, which comprises: an elongated hollow housing having a first opening at a first end thereof;

a reservoir for nail polish removing fluid disposed in said housing;

a continuous belt of absorbent material extending from said reservoir to said opening;

said apparatus further includes means for mounting said belt to permit axial portions of said belt to move from said reservoir to said first opening in said housing;

said means for mounting comprises first and second mounting rollers disposed at axially spaced points;

said means for mounting includes means extending out of said elongated hollow housing for permitting manual rotation of one of said mounting rollers to cause axial portions of said belt to move from said reservoir to said first opening;

said apparatus further includes seal means extending across said housing and around said absorbent material to seal said reservoir at said first opening in said housing;

said seal means comprises elongated openings, said openings engaging discrete axial sections of said belt; and said elongated openings are bounded by at least one rotatably mounted squeezing roller.

2. The apparatus as described in claim 1, further including:

a second opening in said housing which is remotely disposed from said first opening.

* * * * *